US008006450B2

(12) United States Patent
Cretti

(10) Patent No.: US 8,006,450 B2
(45) Date of Patent: Aug. 30, 2011

(54) COMPOSITE FLOOR STRUCTURE WITH A PROTRUDING BAR UPPER PORTION IN A FLOOR ELEMENT GROOVE

(75) Inventor: Piero Cretti, Morbio Superiore (CH)

(73) Assignee: Plastedil S.A., Chiasso (CH)

( * ) Notice: Subject to any disclaimer, the term of this patent is extended or adjusted under 35 U.S.C. 154(b) by 1492 days.

(21) Appl. No.: 11/139,575

(22) Filed: May 31, 2005

(65) Prior Publication Data

US 2006/0075707 A1 Apr. 13, 2006

(30) Foreign Application Priority Data

Oct. 13, 2004 (IT) ..... MI2004A1935

(51) Int. Cl.
*E04B 5/38* (2006.01)

(52) U.S. Cl. ..... 52/320; 52/327; 52/414

(58) Field of Classification Search ..... 52/414, 52/340, 319–330, 576
See application file for complete search history.

(56) References Cited

U.S. PATENT DOCUMENTS

| | | | | | |
|---|---|---|---|---|---|
| 716,628 | A | * | 12/1902 | Dickey | 52/332 |
| 1,602,985 | A | * | 10/1926 | McWilliams | 52/577 |
| 1,729,612 | A | * | 10/1929 | Goldsmith | 52/320 |
| 1,994,716 | A | | 3/1935 | Klemperer | |
| 3,213,581 | A | * | 10/1965 | Macchi | 52/382 |
| 3,382,637 | A | * | 5/1968 | Longinotti | 52/320 |
| 3,721,051 | A | * | 3/1973 | Fork | 52/220.4 |
| 3,979,867 | A | * | 9/1976 | Sowinski | 52/309.11 |
| 4,130,976 | A | | 12/1978 | Kesseler et al. | |
| 4,157,640 | A | | 6/1979 | Joannes | |
| 4,628,654 | A | * | 12/1986 | Boswel | 52/319 |
| 4,633,634 | A | | 1/1987 | Nemmer et al. | |
| 5,245,809 | A | | 9/1993 | Harrington | |
| 5,638,651 | A | | 6/1997 | Ford | |
| 5,797,230 | A | * | 8/1998 | Lassen | 52/323 |
| 5,930,965 | A | * | 8/1999 | Carver | 52/320 |
| 6,205,728 | B1 | | 3/2001 | Sutelan | |
| 6,233,892 | B1 | | 5/2001 | Tylman | |
| 6,298,622 | B1 | * | 10/2001 | Cretti | 52/309.7 |
| 6,453,632 | B1 | * | 9/2002 | Huang | 52/403.1 |
| 6,457,288 | B2 | * | 10/2002 | Zambelli et al. | 52/220.2 |
| 6,708,459 | B2 | | 3/2004 | Bodnar | |
| 7,685,789 | B2 | * | 3/2010 | Houben | 52/576 |

(Continued)

FOREIGN PATENT DOCUMENTS

| | | |
|---|---|---|
| GB | 2365456 | 5/2000 |
| WO | 03008726 A1 | 1/2003 |
| WO | 2004/101905 A1 | 11/2004 |

*Primary Examiner* — Basil Katcheves
*Assistant Examiner* — Matthew J Smith
(74) *Attorney, Agent, or Firm* — Sughrue Mion, PLLC

(57) ABSTRACT

A floor structure (1) of the type having "crossed reinforcement rods" is described comprising:

a) a plurality of composite construction elements (2) arranged side by side and comprising:

a1) an elongated body (3) made of expanded plastic material provided with an upper face (3*a*);

a2) at least one reinforcing section bar (4) longitudinally extending in the elongated body (3) and having an upper portion (4*c*) protruding from the upper face (3*a*) of the body (3);

b) a substantially reticular reinforcement metal structure (10) of a concrete casting (9), supported by the upper portion (4*c*) of the aforementioned at least one reinforcing section bar (4) at a predetermined distance from the upper face (3*a*) of the elongated body (3) made of expanded plastic material.

Advantageously, the floor structure (1) exhibits lightness and self-supporting characteristics and allows to achieve a substantial reduction of the labor and costs for its manufacture.

34 Claims, 6 Drawing Sheets

U.S. PATENT DOCUMENTS 7,814,719 B2 * 10/2010 Cretti ..... 52/340
2003/0014934 A1 * 1/2003 Bodnar ..... 52/443
2004/0118066 A1 * 6/2004 DeLoach, Sr. ..... 52/414
2006/0075701 A1 4/2006 Cretti

* cited by examiner

COMPOSITE FLOOR STRUCTURE WITH A PROTRUDING BAR UPPER PORTION IN A FLOOR ELEMENT GROOVE

BACKGROUND OF THE INVENTION

In one general aspect thereof, the present invention relates to a floor structure comprising a plurality of composite construction elements made of expanded plastic material and a substantially reticular reinforcement metal structure of a concrete casting.

In the following description and in the appended claims, the expression: substantially reticular metal structure, is used to indicate a reinforcement metal structure comprising a plurality of longitudinal reinforcement elements and a plurality of transversal reinforcement elements of the casting crossed with one another so as to form a grid substantially extending along the entire extension of the floor structure to be constructed.

In jargon, the latter is defined as a floor structure having "crossed reinforcement rods" and allows to manufacture floors having a greater length with respect to that which can be obtained by floor structures having the same thickness but not provided with substantially reticular reinforcement metal structures.

In the following description and in the appended claims, the expression: floor, is used to indicate both a horizontal structure adapted to support the floor of each storey of a building (including the floor directly above the ground), and a horizontal or slanting covering structure adapted to close at the top the last storey of the building itself.

In the following description and in the appended claims, the expression: composite construction element, is used to indicate an element comprising an elongated body made of expanded plastic material, for example expanded polystyrene, and at least one reinforcing section bar at least partially incorporated in the elongated body itself.

PRIOR ART

In general, floor structures having "crossed reinforcement rods" are preferably used both in the manufacture of the so-called "wide span" floors, that is, floors having a length greater than 4 meters, and in the manufacture of earthquake-proof structures and this thanks to their limited thickness and weight and to their isotropic behavior in response to transversal stresses.

In the field of the building industry in general and in the manufacture of floors for buildings in particular, the use of construction elements made of expanded plastic material, preferably made of expanded polystyrene, in the form of slabs or section bars of suitable shape and size, is known.

Even though these slabs allow to reduce the overall weight of the floor structure and to improve the sound and heat insulation characteristics, they render the manufacture of floors having crossed reinforcement rods very difficult, since they require a so-called "full shoring", that is, the construction of a temporary supporting formwork constituted by planks made of wood or other suitable materials, adapted to contain the concrete casting poured during the manufacture of the actual floor.

Recently, the use of composite construction elements made of expanded plastic material provided with one or more suitably shaped reinforcing section bars, so as to exhibit appropriate self-supporting characteristics, has also become widespread.

In the following description and in the appended claims, the expressions: "self-support" and "self-supporting construction element" are used to indicate the ability of the construction element to withstand without structural yielding or permanent deformations the stresses undergone during transport and/or installation and, respectively, a construction element exhibiting such mechanical characteristics as to withstand without structural yielding the stresses undergone during transport and/or installation.

Thus, for example, in International patent application WO 98/16703 in the name of the same Applicant a self-supporting composite construction element is described which comprises a central body in which at least one transversal reinforcing section bar is incorporated.

In one embodiment, this self-supporting composite construction element is a floor element usable for manufacturing floor structures and comprises a substantially parallelepipedic central body laterally provided with a pair of lugs longitudinally extending at opposite parts of the central body itself.

Thanks to these structural features, it is possible to assemble a floor structure provided with a series of longitudinal channels adapted to house reinforcing rods and a concrete casting by arranging side by side a plurality of floor elements of this type.

While the floor structure thus obtained exhibits characteristics of low weight, low cost and self-support which allow to replace the "full shoring" with a series of supporting elements suitably spaced from one another, the so-called "temporary supports", it also possesses on the other hand structural features which prevent the manufacture of a structure having "crossed reinforcement rods".

The floor structure that can be manufactured using the composite construction elements described in the aforementioned prior art document, in fact, is not capable of correctly housing nor of correctly supporting the reticular reinforcement metal structures needed to form a floor structure having "crossed reinforcement rods".

SUMMARY OF THE INVENTION

The object of the present invention is that of providing a floor structure provided with suitable lightness and self-supporting characteristics and which is capable at the same time to substantially reduce labor and costs for manufacturing a floor having "crossed reinforcement rods".

According to the invention, this problem is solved by a floor structure comprising:

a) a plurality of composite construction elements arranged side by side and comprising:
   - a1) an elongated body made of expanded plastic material provided with an upper face;
   - a2) at least one reinforcing section bar longitudinally extending in said elongated body and having an upper portion protruding from the upper face of said body;

b) a substantially reticular reinforcement metal structure of a concrete casting, supported by the upper portion of said at least one reinforcing section bar at a predetermined distance from the upper face of said elongated body made of expanded plastic material.

In the following description and in the appended claims, the expressions: "upper" and "lower" will be used to indicate the portions of the various elements forming the floor structure in the laying condition.

Thanks to the aforementioned structural features and, in particular, to the special structure of the composite construction elements which form the "base" of the floor structure of the invention, the latter achieves the following advantageous technical effects:

- suitable self-supporting characteristics with a reduced use of temporary supports;
- simplification of the operations required for laying the substantially reticular reinforcement metal structure, which is effectively supported by the upper protruding portion of the reinforcing section bar longitudinally extending in the elongated body of the construction elements arranged side by side at a predetermined distance from the upper face of such elongated body.

Thanks to this last feature, it is advantageously ensured in a simple and effective manner that the concrete poured on the floor structure can easily fill the spaces below the reinforcement metal structure, as required by the building regulations currently in force.

Advantageously, the floor structure of the invention allows to do without the temporary supports or to use the same only for lengths greater than about 2 meters, with a considerable simplification of the operations required for laying the floor and with an advantageous reduction of time and costs for manufacturing the same.

Advantageously, the manufacture of the floor structure of the invention can be carried out by simply laying the opposite ends of the composite construction elements which constitute the same (manufactured in advance at the factory) on the supporting structures of the building being erected, so as to obtain a base capable of effectively containing—per se or by using a reduced number of temporary supports—the concrete casting.

Advantageously, this base of the floor structure also constitutes a disposable formwork which remains incorporated in the final floor and which contributes to the sound and heat insulation of the latter.

Thanks to the structural features of the composite construction elements, the construction of the base of the floor structure can be carried out with the utmost reduction or even avoiding the use of fixed or mobile scaffolds, which on the contrary are almost invariably needed to install the construction elements of the prior art.

For the purposes of the invention, the substantially reticular metal structure comprises in a way known per se a plurality of transversal and of longitudinal reinforcement elements of the casting crossed with one another so as to form an angle preferably equal to about 90°.

In a particularly preferred embodiment, the reinforcement metal structure of the concrete casting is firmly associated to the composite construction elements at the aforementioned at least one reinforcing section bar by means of fastening means suitable for the purpose.

In this way, the floor structure of the invention advantageously achieves improved characteristics of fire resistance since any optional covering elements of the lower face thereof are firmly held by the reinforcement metal structure embedded in the concrete casting by means of the reinforcing section bar and, in case of fire, they are not detached from the floor structure even in the presence of a complete collapse of the elongated bodies made of expanded plastic material of the composite construction elements constituting the floor structure base.

Preferably, the fastening means of the reinforcement metal structure of the concrete casting is constituted by a staple having a central body substantially shaped as an upturned U and having opposite free ends projecting in a cantilevered fashion from the central body and adapted to engage the upper portion of the aforementioned at least one reinforcing section bar.

Preferably, the transversal and the longitudinal reinforcement elements are also firmly associated to one another in a way known per se, for example by means of strings of conventional type and constituted by the conventional iron wires used to this end in the art.

In a preferred embodiment, which is particularly suitable for manufacturing "wide span" floors, the floor structure of the invention further comprises a plurality of floor elements made of expanded plastic material, supported by the composite construction elements and arranged at a predetermined distance from one another, so as to define a plurality of transversal channels and a plurality of longitudinal channels adapted to house the concrete casting.

Preferably, the floor elements lay on the composite construction elements and are firmly held in place by the upper portion of the aforementioned at least one reinforcing section bar protruding therefrom.

Advantageously, the floor elements made of expanded plastic material allow to reduce the weight of the final floor once the concrete has been cast and therefore to have with the same weight a greater thickness and a greater floor length with respect to the floors having crossed reinforcement rods of the prior art.

Within the framework of this preferred embodiment, the floor elements are preferably provided at a lower side with at least one longitudinal groove adapted to house the upper portion of the aforementioned at least one reinforcing section bar, so as to increase the stability of the connection between the floor elements and the composite construction elements of the floor structure.

Preferably, such a longitudinal groove is configured so as to have a shape substantially mating the shape of the upper portion of the aforementioned at least one reinforcing section bar, so as to have an optimum stability of the connection between the composite construction elements and the floor elements.

Preferably, the floor elements made of expanded plastic material of this preferred embodiment can be provided, if desired, with reinforcing elements and they can be advantageously realized of any desired height, so as to adjust as desired the thickness of the floor structure and, along therewith, the maximum length of the final floor.

Within the framework of this preferred embodiment, the transversal and the longitudinal reinforcement elements of the casting of the substantially reticular metal structure are housed in the transversal channels and, respectively, in the longitudinal channels defined by the floor elements.

In this way, it is advantageously possible to easily realize a so-called "panelled" floor structure in which the zones of reinforced concrete intended to withstand the external stresses are arranged only where needed on the basis of design parameters with a weight reduction of the final floor and a reduction of the costs for manufacturing the same.

In a preferred embodiment, the upper portion of the aforementioned at least one reinforcing section bar is associated to a respective longitudinal rib projecting in a cantilevered fashion from the upper face of the elongated body made of expanded plastic material.

Preferably, this longitudinal rib extends along the elongated body made of expanded plastic material along a portion having a length substantially equal to the length of the aforementioned at least one reinforcing section bar.

In a preferred embodiment, the upper portion of said at least one reinforcing section bar is provided with an upper face, preferably substantially planar, defining a supporting surface for the reinforcement metal structure of the casting. Advantageously, this upper face allows to have an adequate supporting zone of the reinforcement metal structure of the casting with a more effective support of this structure.

Preferably, the upper face of the aforementioned at least one reinforcing section bar is extending at least in part substantially flush with an upper face of the aforementioned longitudinal rib extending from the elongated body made of expanded plastic material.

In this way, it is advantageously possible to achieve an improved structural stiffness of the portion of the composite construction elements intended to support the reinforcement metal structure, a portion that in this case is constituted by the assembly formed by the longitudinal rib and by the upper portion of the aforementioned at least one reinforcing section bar, both projecting in a cantilevered fashion from the upper face of the elongated body made of expanded plastic material.

Preferably, the transversal reinforcement elements of the casting, in particular the lower portions thereof, are supported by the upper portion of the reinforcing section bar; still more preferably, the transversal reinforcement elements of the casting are firmly associated to the reinforcing section bar in any conventional manner, for example by means of the substantially staple-shaped fastening means of the reinforcement metal structure described hereinabove.

In a preferred embodiment, the longitudinal reinforcement elements of the casting lay on the transversal reinforcement elements of the casting, particularly on the lower portion thereof; still more preferably, the longitudinal reinforcement elements are firmly associated to the transversal elements and/or to the reinforcing section bar in any conventional manner, for example by means of the fastening means described above.

Thanks to the aforementioned supporting configuration of the transversal and of the longitudinal reinforcement elements of the casting, it is advantageously possible to arrange the lower portion thereof—i.e. the portion which is traction-stressed—near the lower portion of the floor structure with an increase of the resistance characteristics to the external loads of the final floor.

For the purposes of the invention, the aforementioned at least one reinforcing section bar can be formed according to any suitable shape adapted to define an upper portion protruding from the upper face of the elongated body made of expanded plastic material of the composite construction element and which is capable of supporting the substantially reticular reinforcement structure of the concrete casting.

Preferably, the aforementioned at least one reinforcing section bar is constituted by a material having suitable structural characteristics, for example cold-rolled and preferably galvanized steel, rigid plastic material such as PVC, polycarbonate and polyester polymers, acrylonitrile-butadiene-styrene (ABS) copolymers and the like.

In a preferred embodiment, the aforementioned at least one reinforcing section bar can be coated at least in part and, still more preferably, can be entirely coated with a fire resistant film, for example obtained from a paint selected from the group comprising intumescent paints and antifire paints.

The floor structure of the invention is in this case advantageously provided with further improved characteristics of fire resistance in case of fire thanks to the presence of the aforementioned film.

Advantageously, the reinforcing section bar is obtained from sheets of reduced thickness, for example comprised between 0.4 and 1.2 mm.

Within the framework of the present description and in the following claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

For obvious reasons of construction simplicity and to limit the production costs, the reinforcing section bar is preferably shaped as an L, a C, a Z or an I.

In a preferred embodiment, the upper portion of the aforementioned at least one reinforcing section bar is essentially hook-shaped and, still more preferably, is shaped substantially as a C, substantially as an upturned U or substantially as an L.

Thanks to this configuration, it is possible both to easily define the aforementioned upper face of the upper portion of the reinforcing section bar and to provide means which allows to firmly associate the floor elements made of expanded plastic material to the composite construction elements of the floor structure.

Within the framework of this preferred embodiment, the floor elements are preferably provided at a lower side with the aforementioned at least one longitudinal groove: in this way, the substantially hook-shaped upper portion of the aforementioned at least one reinforcing section bar can engage in a substantially snap-wise manner in the aforementioned at least one longitudinal groove optimizing the stability of the connection between the floor elements and the composite construction elements.

According to a preferred embodiment of the invention, the reinforcing section bar is longitudinally extending in the elongated body of the construction element along substantially the entire length thereof.

In a preferred embodiment of the invention, the aforementioned at least one reinforcing section bar extending in the elongated body made of expanded plastic material of the composite construction elements is provided with a lower portion, preferably substantially planar, extending at least in part substantially parallel to the lower face of said elongated body.

In this way, it is advantageously possible both to achieve improved characteristics of structural stiffness of the elongated body made of expanded plastic material and to provide means adapted to allow the fastening of suitable covering elements of the lower face of the floor structure, described hereinafter, by means of suitable fastening means, such as for example screws or bolts.

For the purposes of the invention, the aforementioned at least one reinforcing section bar is preferably incorporated in the elongated body at the molding stage of the expanded plastic material.

In a first preferred embodiment, the lower portion of the aforementioned at least one reinforcing section bar is extending at least in part substantially flush with the lower face of the elongated body made of expanded plastic material.

In this way, it is advantageously possible to have an easy access to the lower portion of the reinforcing section bar which constitutes the aforementioned means adapted to allow the fastening of suitable covering elements of the lower face of the floor structure, which lower portion which turns out to be visible when fastening the covering elements.

In an alternative preferred embodiment, the lower portion of the aforementioned at least one reinforcing section bar is entirely incorporated in the elongated body made of expanded plastic material and is arranged at a predetermined distance from the lower face of the elongated body. Preferably, the lower portion of the aforementioned at least one reinforcing section bar is extending substantially parallel to the lower face of the aforementioned body at a distance preferably comprised between about 5 mm and about 15 mm from said face.

In this way, it is possible to fasten suitable covering elements of the lower face of the floor structure to the lower portion of the aforementioned at least one reinforcing section bar using fastening means having a limited length.

Since the lower portion of the reinforcing section bar is not visible under the composite construction element, in order to fasten the covering elements it is necessary in this case to know in advance the position of said portion inside the mass of expanded plastic material with respect to any reference element, such as for example with respect to the sides or with respect to the longitudinal center plane of the elongated body made of expanded plastic material.

In a preferred embodiment, the reinforcing section bar is provided with a central body and with a fin extending from a lower side of the central body of the section bar.

In this preferred embodiment, therefore, the lower portion of the reinforcing section bar extending substantially parallel to the lower face of the elongated body made of expanded plastic material and having the function of providing a suitable supporting surface which a suitable covering element can be fastened to, is constituted by the aforementioned lower fin.

As described hereinbefore, such a fin is preferably substantially planar and can either be extending substantially flush with the lower face of the elongated body made of expanded plastic material or entirely incorporated in the mass of expanded plastic material and arranged at a predetermined distance from said lower face.

Preferably, the composite construction element comprises at least two reinforcing section bars longitudinally extending in the elongated body made of expanded plastic material at opposite parts of the longitudinal center plane of said body along a direction substantially parallel to said center plane.

Thanks to this arrangement of the reinforcing section bars, it is advantageously possible to achieve even reinforcement characteristics of the elongated body at opposite parts of the longitudinal center plane. Preferably, the reinforcing section bars are symmetrically arranged in the elongated body with respect to said longitudinal center plane thereof, so as to achieve a balanced and symmetrical reinforcing action.

In this preferred embodiment, the reinforcing section bars of the aforementioned pair are preferably spaced apart from one another by a predetermined distance.

In this way, it is advantageously possible to suitably distribute the reinforcing section bars inside the elongated body made of expanded plastic material achieving a number of advantageous technical effects: possibility of homogeneously distributing the reinforcing action exerted by the reinforcing section bars; possibility of homogeneously distributing the loads applied to the reinforcing section bars (essentially constituted by the weight of the covering elements fastened to their lower portion) and, finally, possibility of arranging in a known and reproducible manner the lower portion of the reinforcing section bars so as to know its position even when said lower portion is completely incorporated in the mass of expanded plastic material and, as such, is not visible from the outside.

Within the framework of this preferred embodiment, furthermore, the reinforcing section bars are preferably provided with respective lower portions, preferably substantially planar, extending at opposite parts of the longitudinal center plane of said elongated body.

The Applicant, in fact, has noted that it is advantageously possible in this case to achieve an improvement of the resistance characteristics to the bending loads of the composite construction element in particular at the opposite sides of the elongated body made of expanded plastic material.

Preferably, furthermore, the upper portion and/or the lower portion of the aforementioned at least one reinforcing section bar is provided with at least one stiffening rib which contributes to increase the structural stability of said portions.

Within the framework of this preferred embodiment, this stiffening rib is longitudinally extending along the centre line of the upper face of the upper portion and/or along the centre line of the lower face of the lower portion of the aforementioned at least one reinforcing section bar.

In this second case, the stiffening rib carries out the additional advantageous function of defining a notch for the introduction of the tip of a screw or of another fastening element adapted to fasten an external covering element to the reinforcing section bar, as will be described hereinafter.

Preferably, furthermore, the reinforcing section bar(s) is(are) advantageously provided with a plurality of openings formed in a central portion thereof.

These openings carry out the dual advantageous function of lightening the reinforcing section bar and of allowing an even more intimate integration thereof in the mass of expanded plastic material.

Thanks to the presence of these openings, in fact, the mass of expanded plastic material is capable of interpenetrating with the reinforcing section bar at the molding stage, integrating and firmly holding in place the reinforcing section bar within the elongated body of the composite construction element.

This intimate integration of the reinforcing section bar in the mass of expanded plastic material, furthermore, prevents any deformation or bending along the transversal direction of the reinforcing section bar even though it is essentially constituted by a fairly thin metal sheet.

According to the invention, the shape of the openings—obtainable in any way known per se, such as for example by punching—is not critical; in any case, it is preferably circular for obvious reasons of construction simplicity.

In a preferred embodiment, the openings are pitchwise arranged in the central portion of the reinforcing section bar along the center plane of the section bar itself.

In an alternative preferred embodiment, the openings are arranged in the central portion of the reinforcing section bar according to three parallel rows: a first central row of circular openings, having a prevailing diameter, pitchwise arranged along the center plane of the reinforcing section bar, and two lateral rows of circular openings, having a smaller diameter, pitchwise arranged at opposite parts of the aforementioned central row.

Preferably, the circular openings of the lateral rows have parallel axes and are arranged between two consecutive openings of the central row.

Advantageously, it is possible in this way to distribute as evenly as possible the so-called void areas throughout the central portion of the reinforcing section bar, in order to lighten its structure without detracting from its mechanical strength, and to evenly distribute the contact surface between the reinforcing section bar and the expanded plastic material.

In a preferred embodiment, the floor structure of the invention further comprises a covering element of a lower face thereof.

According to a first a preferred embodiment, the floor structure of the invention comprises a lath for supporting at least one layer of a suitable covering material associated to a lower face of the elongated body made of expanded plastic material of the composite construction elements which form the base of the floor structure.

In the following description and in the subsequent claims, the expression: lath for supporting at least one covering layer, is used to indicate not only conventional laths having a mesh structure—either smooth or provided with protruding ribs—obtained by stretching a suitably notched metal sheet, but also any sheet-like member adapted to support a layer of a suitable covering material.

Preferably, the lath comprises opposite lateral portions incorporated near the opposite sides of the elongated body made of expanded plastic material of the composite construction elements which form the base of the floor structure.

In this way, the lath can be firmly held by the elongated body made of expanded plastic material.

In order to increase as much as possible the characteristics of fire resistance of the construction element and of the floor structure comprising the same, the material of the covering layer associated to the lath is preferably selected from plaster, cement or other material, optionally incorporating at least one material selected from reinforcing fibers of a suitable material and at least one fire-retardant material, preferably in powder, granules or fibers, adapted to impart an improved fire resistance to the covering material.

Preferably, such fire retardant material is selected from mineral fibers, such as fiber glass, mineral wool, inert materials such as perlite, glass spheres, expanded clay granules or other materials suitable for the purpose and known to those skilled in the art.

In a preferred embodiment, the lath is associated to the lower portion, for example to a lower fin, of the aforementioned at least one reinforcing section bar.

In this way, it is advantageously possible to increase the lath-holding ability of the floor structure and, if the reinforcing section bar is firmly associated to the reinforcement metal structure, also the characteristics of fire resistance of the floor structure itself.

In an alternative preferred embodiment, the covering element of the lower face of the floor structure can be a rigid covering element associated to a lower face of the elongated body made of expanded plastic material of the aforementioned composite construction elements.

Preferably, this rigid covering element is associated to the lower portion, for example to a fin, of the aforementioned at least one reinforcing section bar.

In this way, it is advantageously possible to increase the ability of the floor structure to hold the rigid covering element and, if the reinforcing section bar is firmly associated to the reinforcement metal structure, also the characteristics of fire resistance of the floor structure itself.

Preferably, the aforementioned covering element is a panel of plasterboard, wood, rigid plastic material or other suitable material having an ornamental and/or a structural function, optionally incorporating at least one suitable fire retardant material, preferably in powder, granules or fibers, adapted to impart an improved fire resistance to said rigid covering element.

Preferably, the aforementioned fire retardant material is selected from the materials indicated hereinbefore.

In an alternative preferred embodiment, the rigid covering element can be coated at least in part with a fire resistant film, for example obtained from a paint selected from the group comprising intumescent paints and antifire paints.

According to a further aspect thereof, the present invention also relates to a floor comprising a slab of reinforced concrete supported by a floor structure as described above.

According to a further aspect thereof, the present invention also relates to a floor element for manufacturing a floor structure of a building, comprising:

a1) an elongated body made of expanded plastic material provided with a lower face;

a2) at least one longitudinal groove formed in said elongated body at said lower face.

Advantageously, the floor element of the invention allows to lighten a floor structure preferably of the type having crossed reinforcement rods and can be easily associated to such a structure thanks to the presence of the aforementioned at least one longitudinal groove.

BRIEF DESCRIPTION OF THE DRAWINGS

Additional features and advantages of the invention will become more readily apparent from the description of some preferred embodiments of a floor structure according to the invention, made hereinafter by way of a non-limiting example with reference to the annexed drawings.

In the drawings.

DETAILED DESCRIPTION OF THE PREFERRED EMBODIMENTS

Figure 1:
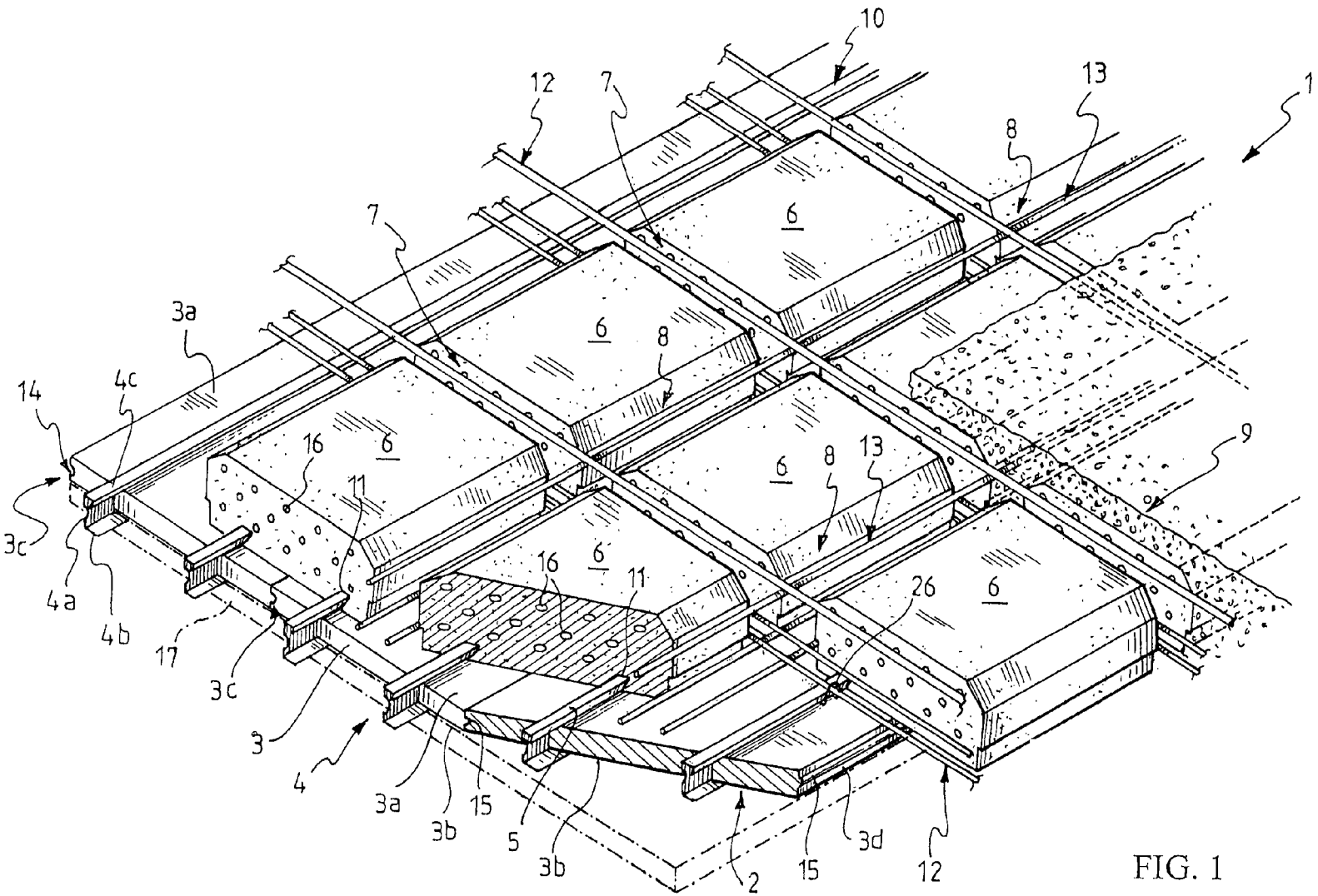
FIG. 1 shows a perspective view, in partial cross-section, of a portion of a floor structure according a preferred embodiment of the invention and comprising a plurality of composite construction elements arranged side by side.
Figure 2:
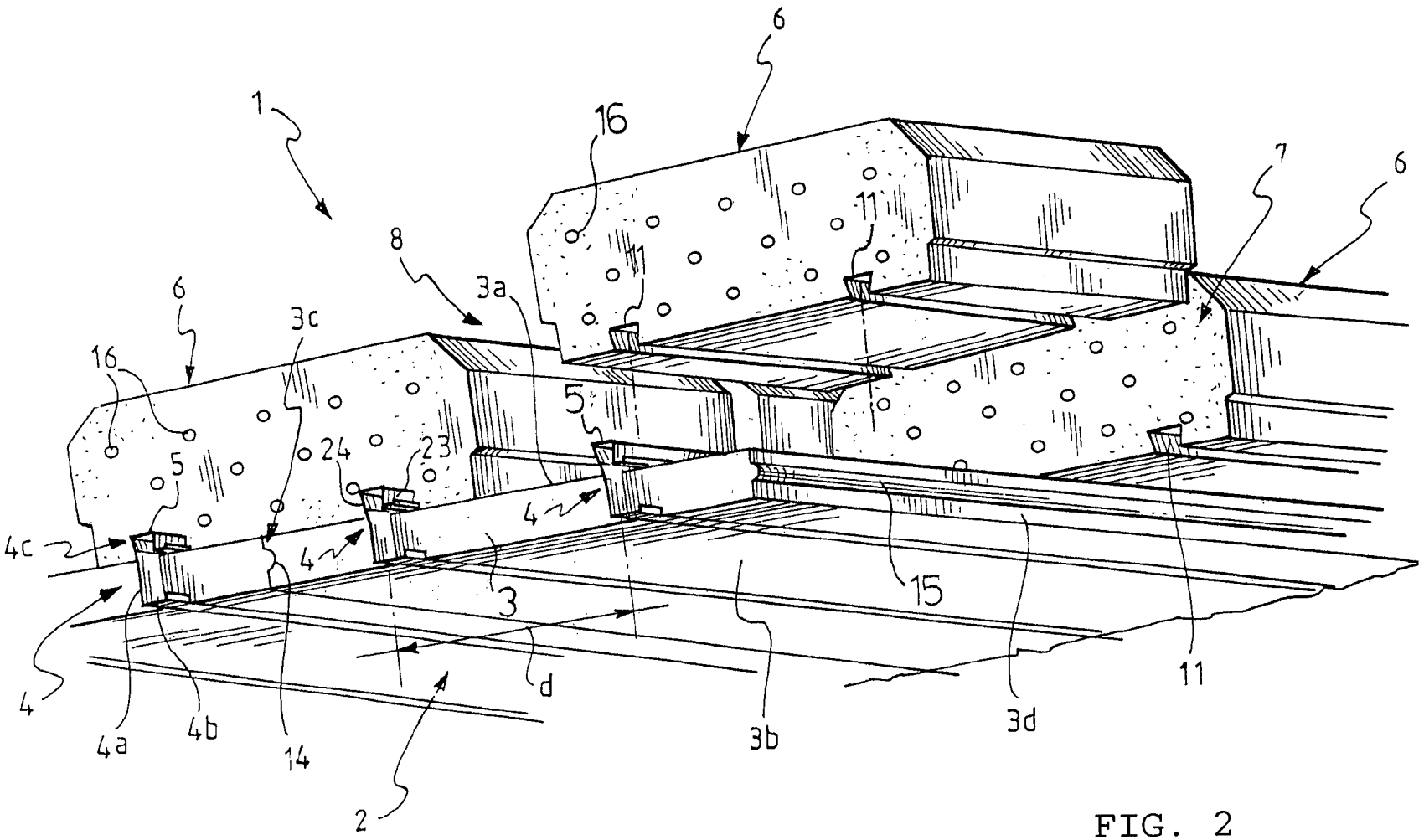
FIG. 2 shows a perspective view, in enlarged scale and in partial cross-section, of some details of the floor structure of FIG. 1.

With reference to FIGS. 1 and 2, a floor structure according to a first preferred embodiment of the invention, particularly suitable for manufacturing the so-called "wide span" floors, is generally indicated at 1.

The floor structure 1 comprises a plurality of composite construction elements 2 arranged side by side, a plurality of floor elements 6 made of expanded plastic material supported by the composite construction elements 2 and a substantially reticular reinforcement metal structure 10 of a concrete casting, schematically indicated at 9 in FIG. 1, arranged between the floor elements 6.

Advantageously, the composite construction elements 2 lay at their opposite ends on respective supporting structures of a building (not shown), such as for example beams and/or load-bearing walls.

In this way, the composite construction elements 2 constitute in this case as many supporting elements adapted to define a base of the floor structure 1 adapted to support the floor elements 6 and the reinforcement metal structure 10 and adapted to contain the concrete casting 9.

Each of the elements which constitute the floor structure 1 will be described in detail hereinafter.

The composite construction elements 2 comprise an elongated body 3 made of expanded plastic material, preferably substantially parallelepipedic in shape, provided with opposite upper and, respectively, lower faces indicated at 3*a*, 3*b*, both substantially planar.

Preferably, the elongated body 3 has the following dimensions, determined at design stage: a thickness comprised between about 40 and about 120 mm and, more preferably, comprised between about 60 and about 80 mm, a width comprised between about 500 and about 1200 mm and, more preferably, comprised between about 600 and about 1000 mm and a length greater than about 500 mm, the maximum length being determined by the design specifications at values substantially selectable as desired.

By way of a non-limiting example, the length of the elongated body 3 can be equal to about 13000 mm.

In this preferred embodiment, the elongated body 3 of each composite construction element 2 is also laterally provided with suitably shaped opposite sides 3*c*, 3*d*, in which a groove 14 and, respectively, a rib 15, preferably having a mating shape and longitudinally extending along the entire length of the elongated body 3, are formed.

In this way, a plurality of construction elements 2 arranged side by side can be firmly connected to one another by means of a substantially joint-wise coupling.

The composite construction elements 2 further comprise at least one reinforcing section bar 4, preferably a pair of reinforcing section bars 4, substantially identical to each other, longitudinally extending in the elongated body 3.

The reinforcing section bars 4 carry out the following advantageous functions:

- they impart suitable self-supporting characteristics to the composite construction elements 2;
- they support the floor elements 6 and firmly hold in place the same;
- they support the reinforcement metal structure 10 of the casting at predetermined distance from the upper face 3*a* of the elongated body 3;
- they support an optional covering element of the lower face of the floor structure 1;
- they impart improved characteristics of fire resistance to the composite construction element 1 if they are partly or entirely coated with a fire resistant film, for example obtained from a paint selected from the group comprising intumescent paints and antifire paints.

In the preferred embodiment illustrated, the reinforcing section bars 4 are longitudinally extending in the elongated body 3 of construction elements 2 along substantially the entire length thereof.

Preferably, the reinforcing section bars 4 are longitudinally extending in the elongated body 3 made of expanded plastic material at opposite parts of the longitudinal center plane of said body along a direction substantially parallel to said center plane.

Still more preferably, the reinforcing section bars 4 are symmetrically arranged in the elongated body 3 with respect to said longitudinal center plane thereof.

Thanks to this arrangement of the reinforcing section bars, it is advantageously possible to achieve balanced and symmetrical reinforcement characteristics of the elongated body at opposite parts of the longitudinal center plane thereof.

Preferably, the reinforcing section bars 4 are made of a material having suitable structural characteristics, such as for example cold-rolled and preferably galvanized steel, shaped in a suitable manner.

In a preferred embodiment, the reinforcing section bars 4 are coated at least in part and, still more preferably, entirely coated with a fire resistant film, for example obtained from a paint selected from the group comprising intumescent paints and antifire paints.

The composite construction element 2 and the floor structure 1 of the invention are in this case advantageously capable of achieving further improved characteristics of fire resistance in case of fire.

By way of example, the reinforcing section bars 4 can be obtained from a sheet having a width comprised between about 100 mm and about 300 mm and, still more preferably, comprised between about 120 mm and about 250 mm and a thickness preferably comprised between about 0.4 mm and about 1.2 mm and still more preferably, comprised between about 0.5 mm and about 0.8 mm.

In the preferred embodiment illustrated, the reinforcing section bars 4 are substantially L-shaped and can be obtained by conventional bending and shearing operations, known per se, starting from a sheet having suitable width and thickness selected, for example, in the ranges mentioned above.

Once these operations have been carried out, the reinforcing section bars 4 are provided with a central body 4*a*, with a lower portion 4*b* and with an upper portion 4*c* protruding from the upper face 3*a* of the elongated body 3 made of expanded plastic material.

Preferably, the upper portion 4*c* of the reinforcing section bars 4 is provided with an upper face 5, preferably substantially planar, defining a supporting surface for the substantially reticular reinforcement metal structure 10 of the casting.

Preferably, the distance between the upper face 5 of the upper portion 4*c* of the reinforcing section bars 4 and the upper face 3*a* of the elongated body 3 made of expanded plastic material is comprised between about 20 mm and about 60 mm and, still more preferably, is comprised between about 30 mm and about 40 mm.

Thanks to this last feature, it is advantageously ensured in a simple and effective manner that the concrete casting 9 can easily fill the spaces below the reinforcement metal structure 10, as required by the building regulations currently in force.

Advantageously, the upper portion 4*c* of the reinforcing section bars 4 is substantially hook-shaped and substantially has the shape of an upturned U.

Thanks to this feature, the upper portion 4*c* of the reinforcing section bars 4—preferably essentially constituted by a fairly thin metal sheet—substantially acts as a spring upon its engagement with the floor elements 6.

Preferably, the upper portion 4*c* of the reinforcing section bars 4 is provided in this case with substantially tapered lateral portions, indicated at 23 and 24, so as to increase the spring effect achieved by this substantially hook-wise configuration.

Preferably, the central portion 4*a* of the reinforcing section bar has, after bending, a height comprised between about 60 mm and about 285 mm, whereas the lower portion 4*b* of the section bar has a length comprised between about 15 mm and about 40 mm and, still more preferably, comprised between about 30 mm and about 40 mm.

In the preferred embodiment illustrated in FIG. 1, the lower portion 4*b* of the reinforcing section bars 4 is preferably substantially planar and is for example constituted by a fin projecting in a cantilevered fashion from the central portion 4*a* of the reinforcing section bar.

The fin 4*b* is preferably extending substantially flush with and substantially parallel to the lower face 3*b* of the elongated body 3.

This fin 4*b* of the reinforcing section bars 4 exerts the function of providing a suitable supporting surface which a suitable covering element of the lower face of the floor structure 1, such as for example a rigid panel 17 of plasterboard or, optionally, a stretched lath for supporting at least one covering layer (not shown in FIG. 1), can be fastened to.

In a preferred embodiment, the rigid panel 17 can incorporate at least one suitable fire retardant material, preferably in powder, granules or fibers, adapted to impart an improved fire resistance to said rigid covering element.

Preferably, such a fire retardant material is selected from the materials indicated above.

In an alternative preferred embodiment, the rigid panel 17 can be coated at least in part with a fire resistant film, for example obtained from a paint selected from the group comprising intumescent paints and antifire paints.

If the covering element of the lower face of the floor structure 1 is constituted by a covering layer supported by a stretched lath, such advantageous characteristics of improved fire resistance can be achieved by incorporating at least one suitable fire retardant material in the material used for forming the layer (for example plaster or cement).

The rigid panel 17 can be fastened to the fins 4*b* in a way known per se, for example by means of screws known per se and not shown.

In the preferred embodiment illustrated in FIG. 1, the lower fins 4*b* of the reinforcing section bars 4 are provided with a first rectilinear portion, substantially perpendicular to the central portion 4*a* of the reinforcing section bar and with a second inclined end portion forming an angle of predetermined value with the first rectilinear portion.

Preferably, the first portion of the lower fins 4*b* is extending flush with and substantially parallel to the lower face 3*b* of the elongated body 3, whereas the second portion of the lower fins 4*b* forms, with respect to the aforementioned first portion, an angle comprised between 40° and 120° and, still more preferably, equal to about 90°.

Tests carried out by the Applicant have shown that such a configuration of the fins 4*b* contributes to further stiffen the reinforcing section bars 4, thus further increasing the self-supporting and compression-resistance characteristics of the composite construction elements 2.

Advantageously, furthermore, the first portion of the lower fins 4*b* exerts the function of providing a suitable supporting surface which a covering element, for example a rigid panel or a lath for supporting at least one layer of plaster, can be fastened to, while the end portion increases the reinforcing action to the bending loads carried out by the reinforcing section bars 4.

In the preferred embodiment illustrated, the reinforcement metal structure 10 of the concrete casting 9 is firmly associated to the composite construction elements 2 at the reinforcing section bars 4.

Preferably, the reinforcement metal structure 10 is advantageously firmly associated to the reinforcing section bars 4 by a means of a plurality of staples 26 having a central body 26*a* substantially shaped as an upturned U and having opposite free ends 26*b*, 26*c* projecting in a cantilevered fashion from the central body 26*a* and adapted to engage the upper portion 4*c* of the reinforcing section bars 4.

Preferably, the staples 26 are constituted by a wire of a suitable structural material, for example metal, so as to constitute substantially spring-wise connecting means thanks to the elasticity of the material.

Thanks to the ensuing stable association of the reinforcing section bars 4 to the reinforcement metal structure 10, the composite construction element 2 advantageously allows to achieve improved characteristics of fire resistance since the covering elements, in this case the plasterboard panels 17 associated to the lower face 3*b* of the elongated body 3, are firmly held by the reinforcement metal structure 10 embedded in the concrete casting 9 by means of the reinforcing section bars 4.

In case of fire, therefore, the plasterboard panels 17 do not detach from the composite construction element 2 even in the presence of a complete collapse of the elongated body 3 made of expanded plastic material.

In this preferred embodiment, furthermore, the reinforcing section bars 4 of the aforementioned pair are preferably spaced at a predetermined distance from one another, so as to suitably distribute the reinforcing section bars 4 in the elongated body 3, thus obtaining some advantageous technical effects: possibility of homogeneously distributing the reinforcing action exerted by the reinforcing section bars; possibility of homogeneously distributing the loads applied to the reinforcing section bars 4 and, finally, possibility of arranging in a known and reproducible manner the lower portion 4*b* of the reinforcing section bars so as to know its position even when such a lower portion is entirely embedded in the mass of expanded plastic material and, as such, not visible from the outside.

In the preferred embodiment illustrated in FIGS. 1 and 2, the reinforcing section bars 4 are arranged in the elongated body 3 at a predetermined distance from one another, preferably, the distance d between the centre line of the lower fins 4*b*—measured along a direction substantially perpendicular to the longitudinal axis of the elongated body 3—is equal to about 300 mm.

The composite construction element 2 illustrated hereinabove can be advantageously obtained by means of operations known in the art, for example using known equipment for manufacturing the reinforcing section bars 4 and known equipment for the continuous or discontinuous molding of the elongated body 3 made of expanded plastic material incorporating the section bars.

In the illustrated example, each floor element 6 comprises a substantially parallelepipedic central body 6*a*, in which a plurality of parallel cavities 16 is longitudinally defined.

Advantageously, the floor elements 6 made of expanded plastic material can be advantageously realized with any desired height, so as to adjust as desired the thickness of the floor structure 1 and, therefore, the maximum length of the final floor.

Preferably, the floor elements 6 have a thickness comprised between about 160 mm and about 500 mm and, still more preferably, comprised between about 180 mm and about 300 mm.

Preferably, the floor elements 6 have the following further dimensions, determined at design stage: a width comprised between about 450 and about 500 mm and a length greater than about 300 mm, the maximum length being determined by the design specifications at values substantially selectable as desired.

By way of a non-limiting example, the length of the floor elements 6 can be comprised between 300 mm and 13000 mm.

Preferably, the floor elements 6 made of expanded plastic material supported by the composite construction elements 2 are arranged at a predetermined distance along the floor structure 1—both along the longitudinal direction and along the transversal direction—so as to form a grid of transversal channels 7 and of longitudinal channels 8, substantially perpendicular to one another, adapted to house the concrete casting 9.

Advantageously, the width of the channels 7 and 8 can be determined by a man skilled in the art on the basis of the design specifications. By way of an example only, such a width may be comprised between about 100 and about 200 mm.

In this preferred embodiment of the floor structure 1, the composite construction elements 2 thus constitute as many joists on which the floor elements 6 rest to form a so-called "panelled" floor structure.

Within the framework of this preferred embodiment, the floor elements 6 are preferably provided at a lower side with at least one longitudinal groove 11 adapted to house the upper portion 4*c* of the reinforcing section bars 4, so as to have a firm connection between the floor elements 6 and the composite construction elements 2 of the floor structure 1.

Preferably, the longitudinal groove 11 is configured so as to have a shape substantially mating the shape of the upper portion 4*c* of the reinforcing section bars 4 protruding from the composite construction elements 2, so as to increase the stability of the connection between the latter and the floor elements 6.

Thus, for example, in the preferred embodiment illustrated in FIGS. 1 and 2, the longitudinal groove 11 is substantially dovetail-shaped with opposite lateral walls tapered in such a way as to firmly hold in the groove, with a substantially snap-wise connection, the upper portion 4*c* of the reinforcing section bars 4 having in turn tapered lateral portions 23, 24.

According to the invention and as described above, the reinforcement metal structure 10 of the concrete casting 9 is supported by the upper portion 4*c* of the reinforcing section bars 4 at a predetermined distance from the upper face 3*a* of the elongated body 3 made of expanded plastic material.

Within the framework of this preferred embodiment, the reinforcement metal structure 10 of the casting comprises a plurality of transversal reinforcement elements of the casting, generally indicated at 12, and a plurality of longitudinal reinforcement elements of the casting, generally indicated at 13, respectively housed in the aforementioned transversal and longitudinal channels 7, 8.

In this way, it is advantageously possible to realize, within the framework of the aforementioned "panelled" floor structure, zones of reinforced concrete arranged only where needed on the basis of the design parameters, with a reduction of the weight and of the costs for manufacturing the final floor.

Preferably, the transversal reinforcement elements 12 of the casting lay on the upper face 5 of the reinforcing section bar 4 and are firmly associated thereto in any conventional manner, for example by means of the staples 26.

In this preferred embodiment, the longitudinal reinforcement elements 13 of the casting lay on the transversal reinforcement elements 12 and are firmly associated thereto in any conventional manner, for example by means of strings 27 of conventional type and constituted by the usual iron wires used to this end in the art.

For the purposes of the invention, the specific shape and structure of the transversal and of the longitudinal reinforcement elements 12, 13 of the reinforcement metal structure 10 is not critical, provided that they supply the necessary amount of metal according to the design specifications. Thus, for example, the transversal and the longitudinal reinforcement elements 12, 13 of the reinforcement metal structure 10 can be constituted by a plurality of iron rods suitably spaced from one another or they can be constituted by substantially trestle-shaped structures according to what is known to a man skilled in the art.

From the foregoing description, the features and the technical effects that can be achieved by the floor structure 1 of the invention are immediately clear.

Thanks to the structural features of the composite construction elements 2 and, in particular, to their self-supporting characteristics and to their ability of supporting the reinforcement metal structure 10, it is possible in the first place to minimize the labor required to manufacture the final floor at the yard.

The operations required to manufacture the final floor, in fact, essentially comprise the steps of laying a plurality of composite construction elements 2 on the load-bearing structures of the building being erected, of arranging thereon the floor elements 6 and the reinforcement metal structure 10 and, then, of casting the concrete 9 on the floor structure 1 thus assembled.

Once the floor structure 1 has been assembled, the function of containing the concrete casting is ensured by the transversal and by the longitudinal channels 7, 8 defined between the floor elements 6 and the composite construction elements 2.

Advantageously, the aforementioned operating steps can be carried out without using temporary supports for lengths of the floor structure 1 up to about 2 meters or using a limited number thereof for greater lengths.

Advantageously, furthermore, the aforementioned laying step of the composite construction elements 2 can be readily carried out with a minimum labor, thanks to the compactness, lightness and handiness of the elements themselves.

Finally, the floor structure 1 according to the invention achieves improved characteristics of fire resistance in case of fire thanks to one or more of the following features:

- to the fact that the covering elements, in this case constituted by the rigid panels 17, associated to the lower face of the floor structure 1 are firmly held by the reinforcement metal structure 10 embedded in the concrete casting 9 by means of the reinforcing section bars 4;
- to the fact that the reinforcing section bars 4 can be coated at least in part with a fire resistant film;
- to the fact that the covering elements associated to the lower face of the floor structure 1 can incorporate at least one fire retardant material adapted to impart an improved fire resistance or to the fact that the covering elements can be coated at least in part with a fire resistant film.

FIGS. 3-10 schematically illustrate additional embodiments of the reinforcing section bars 4, of the composite construction elements 2 and of the floor structure 1 according to the present invention. These additional embodiments achieve both the advantageous technical effects of the embodiment described above and the further technical effects detailed hereinafter.

In the following description and in such figures, the components of the floor structure 1 structurally or functionally equivalent to those illustrated with reference to the previous embodiment shall be indicated with the same reference numerals and will not be further described.

Figure 3:
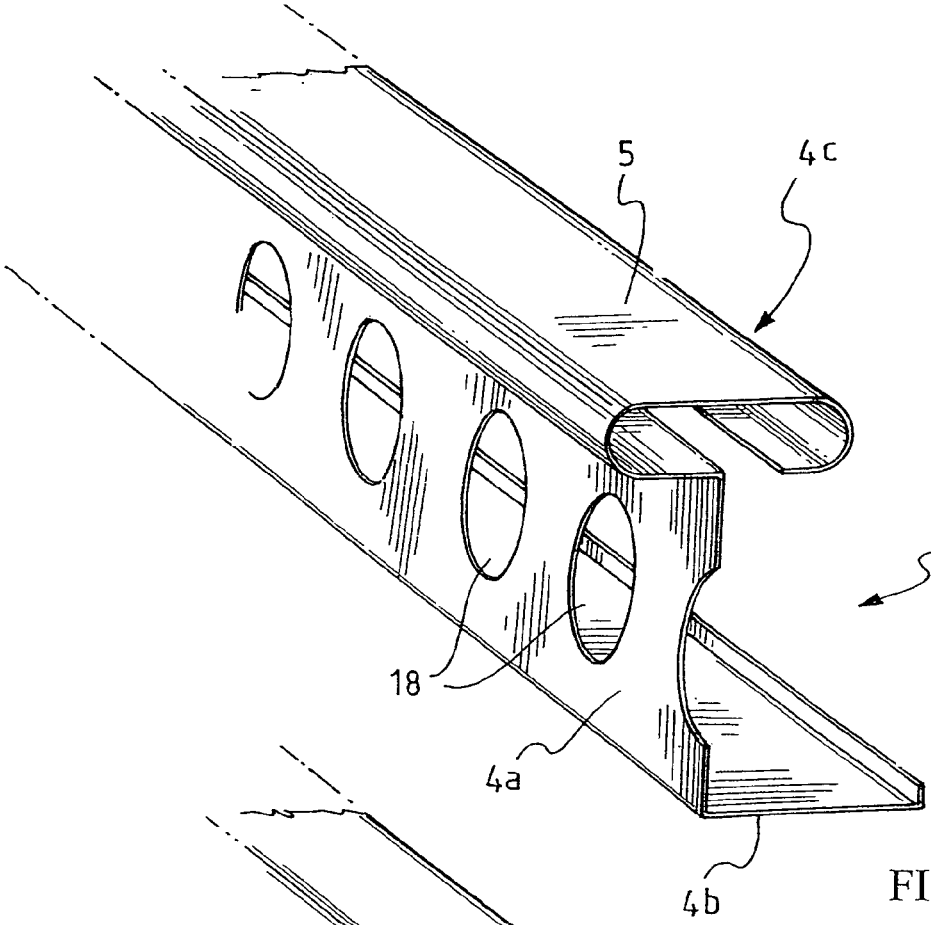
FIGS. 3 and 4 show perspective views, in enlarged scale, of some alternative preferred embodiments of the reinforcing section bar extending in the composite construction elements belonging to the floor structure of the invention.

According to the embodiment of the invention illustrated in FIG. 3, the reinforcing section bars 4 of the composite construction elements 2 are provided with a substantially hook-wise upper portion 4*c* essentially shaped as a T.

In this case, the horizontal portion of the T is constituted by a substantially box-shaped structure the back of which defines the upper face 5 intended to support the reinforcement metal structure 10 of the casting (not shown) and to engage in a substantially snap-wise manner the grooves 11 formed at a lower side of the floor elements 6 (also not shown).

In this embodiment, the reinforcing section bars 4 are advantageously provided with a plurality of openings 18, preferably of circular shape, formed in the central portion 4*a* thereof comprised between the lower and the upper portions 4*b*, 4*c*.

The openings 18 carry out the dual advantageous function of lightening the reinforcing section bars 4 and of allowing an even more intimate integration thereof in the mass of expanded plastic material.

Thanks to the presence of the openings 18, in fact, the mass of expanded plastic material is capable of interpenetrating with the reinforcing section bars 4 at the molding stage, integrating and firmly holding in place the reinforcing section bars in the elongated body 3 of the composite construction element 2.

This intimate integration of the reinforcing section bars 4 in the mass of expanded plastic material, furthermore, prevents any deformation or bending along the transversal direction of the reinforcing section bars 4 even though they are essentially constituted by a fairly thin metal sheet.

Preferably, the openings 18 have a total area comprised between about 5% and about 50% of the total area of the reinforcing section bar, where the expression: total area of the reinforcing section bar, is used to indicate the area of the overall surface of the section bar including that of the upper and lower portions 4*c*, 4*b* (that is, the area of the total lateral surface before forming such portions and the openings 18).

Still more preferably, the openings 18 formed in the central portion 4*a* of the reinforcing section bars 4 have a total area comprised between about 10% and about 30% of the total area thereof.

The openings 18 have a diameter preferably comprised between about 15 mm and about 100 mm and, more preferably, comprised between about 30 mm and about 60 mm.

In a preferred embodiment, the openings 18 are pitchwise arranged in the central portion 4*a* of the reinforcing section bars 4 along the center plane of the section bars themselves.

Preferably, the pitch of the openings 18 is comprised between about 50 and about 100 mm and, still more preferably, is equal to about 75 mm.

Figure 4:
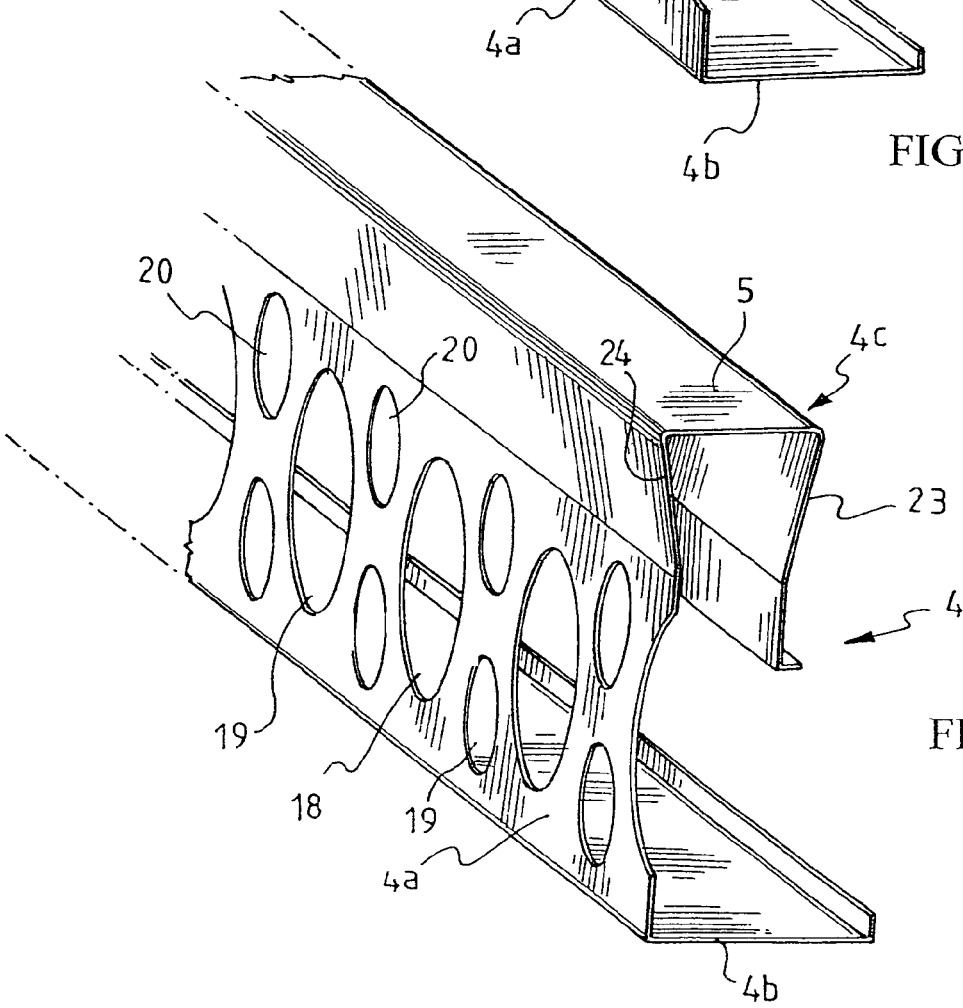

According to the embodiment of the invention illustrated in FIG. 4, the reinforcing section bars 4 of the composite construction elements 2 are provided with an upper portion 4*c* substantially similar to the upper portion of the embodiment illustrated with reference to FIGS. 1 and 2.

In this embodiment, the reinforcing section bars 4 are advantageously provided with a plurality of openings indicated at 18, 19 and 20 formed in the central portion 4*a* thereof, comprised between the lower and upper portions 4*b*, 4*c*.

In this case, the openings 18-20 are arranged in the central portion 4*a* of the reinforcing section bar 4 according to three parallel rows: a first central row of openings 18 preferably of circular shape, having a prevailing diameter, pitchwise arranged along the center plane of the reinforcing section bar 4, and two lateral rows of openings 19, 20, preferably of circular shape, having a smaller diameter, pitchwise arranged at opposite parts of the aforementioned central row.

Preferably, the openings 19, 20 of the lateral rows have parallel axes and are arranged between two consecutive openings 18 of the central row.

Advantageously, it is possible in this way to distribute as evenly as possible the so-called void areas throughout the central portion 4*a* of the reinforcing section bar 4, in order to lighten its structure without detracting from its mechanical strength, and to evenly distribute the contact surface between the reinforcing section bars 4 and the expanded plastic material.

Preferably, the pitch of the openings 18 of the central row is equal to that of the openings 19, 20 of the lateral rows and is comprised between about 50 and about 100 mm and, still more preferably, equal to about 75 mm.

Preferably, furthermore, the openings 18 of the central row have a diameter comprised between about 15 mm and about 100 mm and, still more preferably, comprised between about 30 and about 60 mm, while the openings 19, 20 of the lateral rows have a diameter comprised between about 20 mm and about 60 mm and, still more preferably, comprised between about 30 and about 50 mm.

Figure 5:
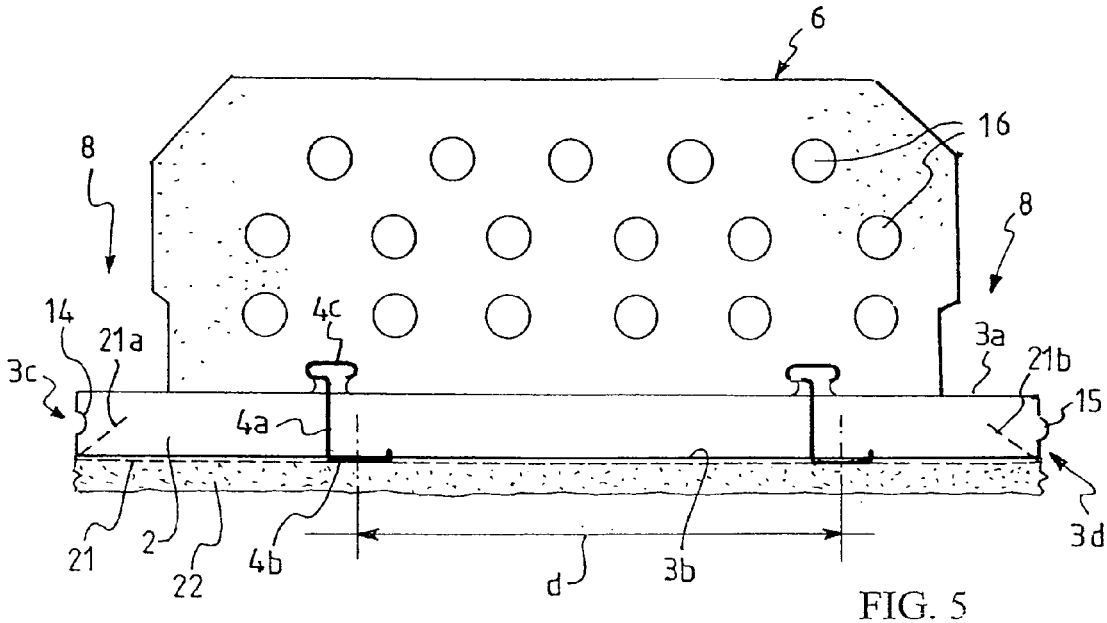
FIG. 5 shows a front view of a portion of a floor structure according to a preferred embodiment of the invention.

According to the embodiment of the invention illustrated in FIG. 5, the floor structure 1 comprises a plurality of composite construction elements 2 provided with reinforcing section bars 4 similar to those illustrated in FIG. 3 and with a lath 21 associated to the lower face 3*b* of the elongated body 3 of each composite construction element 2.

Advantageously, the lath 21 is adapted to support at least one layer 22 of a suitable covering material, for example of plaster or cement, optionally incorporating at least one material selected from reinforcing fibers of a suitable material and at least one fire retardant material adapted to impart an improved fire resistance to the covering material, which can be applied after laying the floor structure 1 or manufacturing the actual floor.

Preferably, the lath 21 is a stretched metal lath essentially formed by a rhomb-shaped mesh having a length-to-height rhomb ratio of 2:1

Preferably, the rhomb length varies between about 20 and about 60 mm, while the rhomb width varies between about 10 and about 30 mm.

Preferably, furthermore, such a stretched lath has a thickness comprised between about 0.4 mm and about 1.0 mm and, still more preferably, comprised between about 0.4 mm and about 0.8 mm.

Preferably, the lath 21 comprises opposite lateral portions 21*a*, 21*b* incorporated near the opposite sides 3*c*, 3*d* of the elongated body 3 made of expanded plastic material.

In this way, the lath 21 can be firmly held by the elongated body 3 made of expanded plastic material.

In the preferred embodiment illustrated in FIG. 5, the lath 21 is further associated to the lower portion 4*b*, for example shaped as a fin, of the reinforcing section bars 4.

In this way, it is advantageously possible to increase the ability of the floor structure 1 of holding the lath 21 and, if the reinforcing section bars 4 are firmly associated to the reinforcement metal structure 10, also the characteristics of fire resistance of the floor structure 1 itself.

In this preferred embodiment, furthermore, the floor elements 6 are arranged so that each longitudinal row of floor elements 6 is supported by one and the same composite construction element 2.

In this case, it is therefore advantageously possible to pre-assemble at the factory a plurality of floor elements 6 longitudinally aligned on one and the same composite construction element 2 with an additional simplification of the laying operations of the floor structure 1 carried out at the yard.

Figure 6:
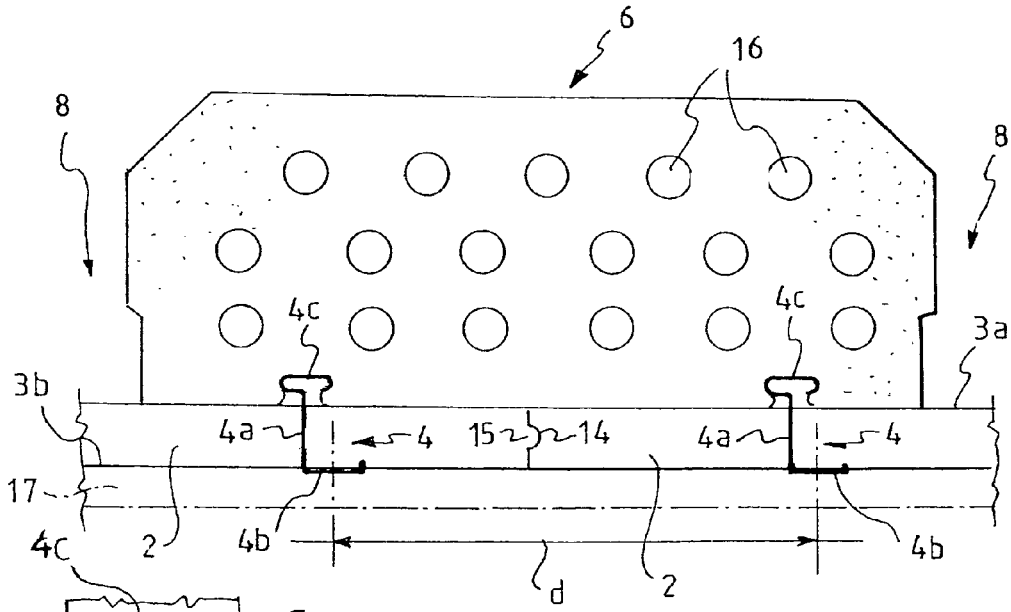
FIG. 6 shows a front view of a portion of a floor structure according to an additional preferred embodiment of the invention.

According to the embodiment of the invention illustrated in FIG. 6, the floor structure 1 comprises a plurality of composite construction elements 2 provided with reinforcing section bars 4 similar to those illustrated in FIG. 3.

In this case, rigid panels 17 made for example of plasterboard, are associated to the lower face 3*b* of the elongated body 3 of each composite construction element 2 similarly to what has been illustrated with reference to the floor structure 1 of FIG. 1.

In this preferred embodiment, the floor elements 6 are arranged astride the composite construction elements 2 according to an arrangement similar to that of FIG. 1.

Thanks to this arrangement, it is advantageously possible to increase the characteristics of mechanical resistance of the floor structure 1 since the stresses imparted to the structure by the concrete casting 9 do not involve the portions of the elongated bodies 3 made of expanded plastic material projecting in a cantilevered fashion (i.e. the portions of plastic material extending between the reinforcing section bars 4 and the sides 3*c*, 3*d* of the elongated bodies 3).

Figure 7:
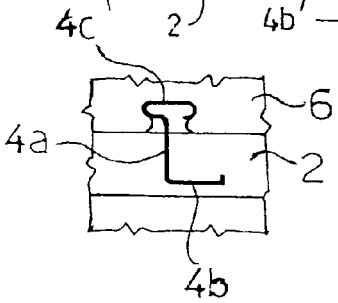
FIG. 7 shows a front view of a detail of a floor structure according to an additional preferred embodiment of the invention.

According to the embodiment of the invention illustrated in FIG. 7, the floor structure 1 comprises a plurality of composite construction elements 2 provided with reinforcing section bars 4 having a lower portion 4*b* entirely incorporated in the elongated body 3 made of expanded plastic material.

Preferably, the lower portion 4*b* is substantially fin-shaped and is arranged at a distance preferably comprised between about 5 mm and about 15 mm from the lower face 3*b* of the elongated body 3.

In this way, it is possible to fasten suitable covering elements of the lower face of the floor structure 1 to the lower portion 4*b* of the reinforcing section bars 4 using fastening elements of limited length.

Since the lower portion 4*b* of the reinforcing section bars 4 is not visible below the composite construction elements 2, in order to fasten the covering elements it is necessary in this case to know in advance the position of said portion inside the mass of expanded plastic material with respect to any reference element, such as for example with respect to the sides 3*c*, 3*d* or with respect to the longitudinal center plane of the elongated body 3 made of expanded plastic material.

Figure 8:
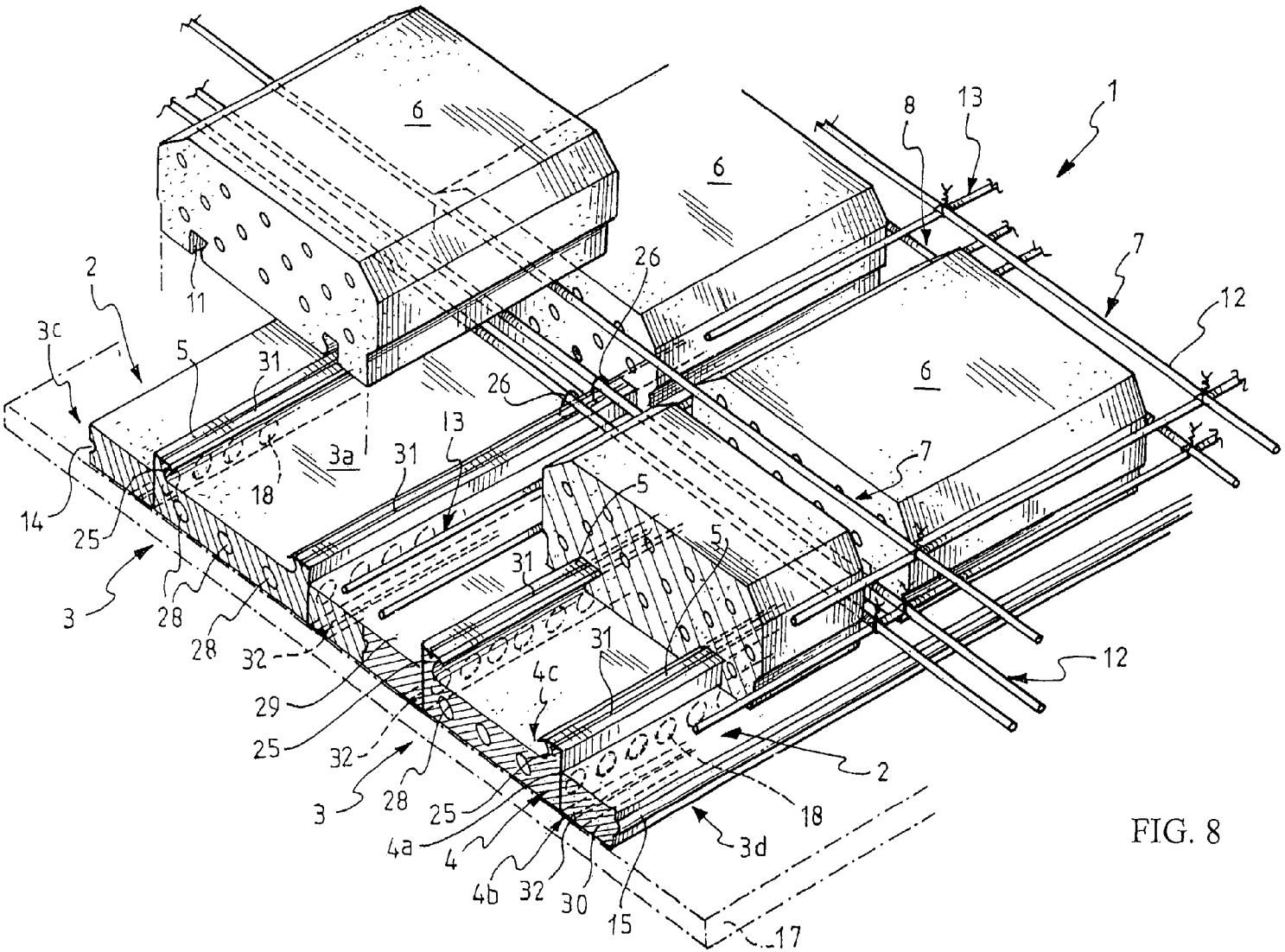
FIG. 8 shows a perspective view, in enlarged scale and in partial cross-section, of an alternative preferred embodiment of the floor structure of the invention.
Figure 9:
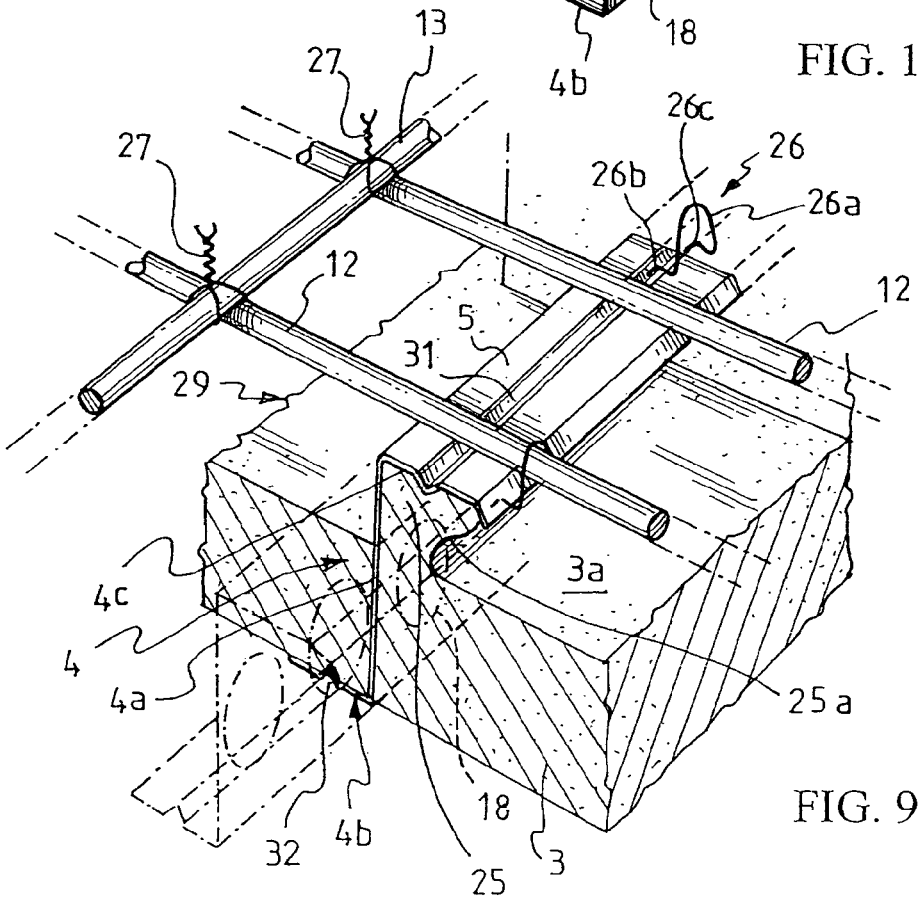
FIG. 9 shows a perspective view, in enlarged scale, of some details of the floor structure of FIG. 8.

According to the embodiment of the invention illustrated in FIGS. 8 and 9, the elongated body 3 of the composite construction elements 2 is provided with a plurality of cavities 28 substantially parallel to one another and longitudinally extending in a central portion of the elongated body 3 between the reinforcing section bars 4.

Advantageously, the cavities 28 contribute to lighten the elongated body 3 rendering the same easier to handle during the installation.

The elongated body 3 made of expanded plastic material is further provided with a plurality of longitudinal ribs 25 made of expanded plastic material, substantially parallel to one another, projecting in a cantilevered fashion from the upper face 3*a* of the elongated body 3 at opposite parts of the longitudinal center plane thereof.

In this preferred embodiment, the elongated body 3 made of expanded plastic material is further provided with a pair of projections 29, 30 laterally and longitudinally extending at opposite parts of the longitudinal ribs 25 towards the opposite sides 3*c*, 3*d* of the elongated body 3 in which the groove 14 and, respectively, the rib 15 are formed.

Preferably, the longitudinal ribs 25 are integrally extending substantially perpendicularly to the upper face 3*a* of the elongated body 3 and are preferably obtained at the molding stage of the elongated body 3.

In this preferred embodiment, the reinforcing section bars 4 of the composite construction elements 2 are substantially Z-shaped and each comprises respective upper portions 4*c* associated to the longitudinal ribs 25 made of expanded plastic material projecting in a cantilevered fashion from the upper face 3*a* of the elongated body 3.

In this preferred embodiment, the lower and upper portions 4*b*, 4*c* of the reinforcing section bars 4 are constituted by respective fins perpendicularly extending from the ends of the central portion 4*a* at opposite parts thereof.

Preferably, furthermore, the upper face 5 of the upper fins 4*c* of the reinforcing section bars 4 is extending at least in part substantially flush with an upper face 25*a* of the longitudinal ribs 25 of the elongated body 3 made of expanded plastic material.

In this way, the assembly constituted by the longitudinal ribs 25 and by the fins 4*c* forms a rigid structure adapted to effectively support the reinforcement metal structure 10.

Similarly to what has been described hereinabove with reference to the previous embodiment of the floor structure 1, the floor elements 6 are provided with longitudinal grooves 11 having a shape substantially mating the shape of the longitudinal ribs 25 incorporating the upper fins 4*c* of the reinforcing section bars 4 and are engageable with a substantially snap-wise connection on such ribs.

Similarly to the embodiments illustrated hereinabove, the fins 4*b*, 4*c* comprise also in this case a first substantially rectilinear portion substantially perpendicular to the central portion 4*a* of the reinforcing section bars 4 and a second portion, or end portion, inclined and forming an angle of predetermined value with the first portion.

Preferably, the first portion of the fins 4*b*, 4*c* has a width equal to about 40 mm, while the end portion has a width equal to about 5 mm and forms with respect to the first portion an angle equal to about 90° in the case of the lower fins 4*b* and equal to about 45° in the case of the upper fins 4*c*.

In an alternative embodiment, the end portion of the upper fins 4*c* can be radiused to the first portion by means of a substantially curvilinear joining zone.

Preferably, the reinforcing section bars 4 are arranged in a mirror fashion at opposite parts of the longitudinal center plane of the elongated body 3 so as to impart optimum load-resistance characteristics to the composite construction element 2 as a whole.

Thanks to this arrangement, the reinforcing section bars 4 are provided with lower fins 4*b* extending at opposite parts of the longitudinal center plane of the elongated body 3 made of expanded plastic material so as to form a configuration which advantageously improves the characteristics of resistance to the bending loads of the composite construction element 2, in particular those to the loads applied on the projections 29, 30 of the elongated body 3 made of expanded plastic material arranged between the reinforcing section bars 4 and the opposite sides 3*c*, 3*d* of the aforementioned body.

In the preferred embodiment illustrated in FIGS. 8 and 9, the upper and lower fins 4*c*, 4*b* of the reinforcing section bars 4 are provided with respective longitudinal ribs 31, 32 adapted to stiffen the structure thereof, and in the case of the lower fins 4*b*, adapted to constitute a notch for the introduction of the tip of fastening means, for example screws, for anchoring a rigid covering element, for example the plasterboard panel 17, to the reinforcing section bars 4.

Similarly to the embodiments illustrated above, the reinforcing section bars 4 can be coated at least in part and, still more preferably, can be entirely coated with a fire resistant film, for example obtained from a paint selected from the group comprising intumescent paints and antifire paints.

The composite construction element 2 and the floor structure 1 of the invention are in this case advantageously capable of achieving further improved characteristics of fire resistance in case of fire.

Similarly to the embodiments illustrated hereinabove, furthermore, the reinforcing section bars 4 are provided with a plurality of openings 18, preferably having a circular shape, formed in the central portion 4*a* comprised between the lower and upper fins 4*b*, 4*c*.

Also in this case, the openings 18 carry out the dual advantageous function of lightening the reinforcing section bars 4 and of allowing an even more intimate integration thereof in the mass of expanded plastic material.

In this preferred embodiment, furthermore, the staples 26 engage—by means of their ends 26*b*, 26*c*—the lower portion of the longitudinal ribs 25 which forms an undercut which is hooked by the aforementioned ends.

Similarly to what has been illustrated in FIG. 5, the floor elements 6 are arranged so that each longitudinal row of floor elements 6 is supported by one and the same composite construction element 2.

Figure 10:
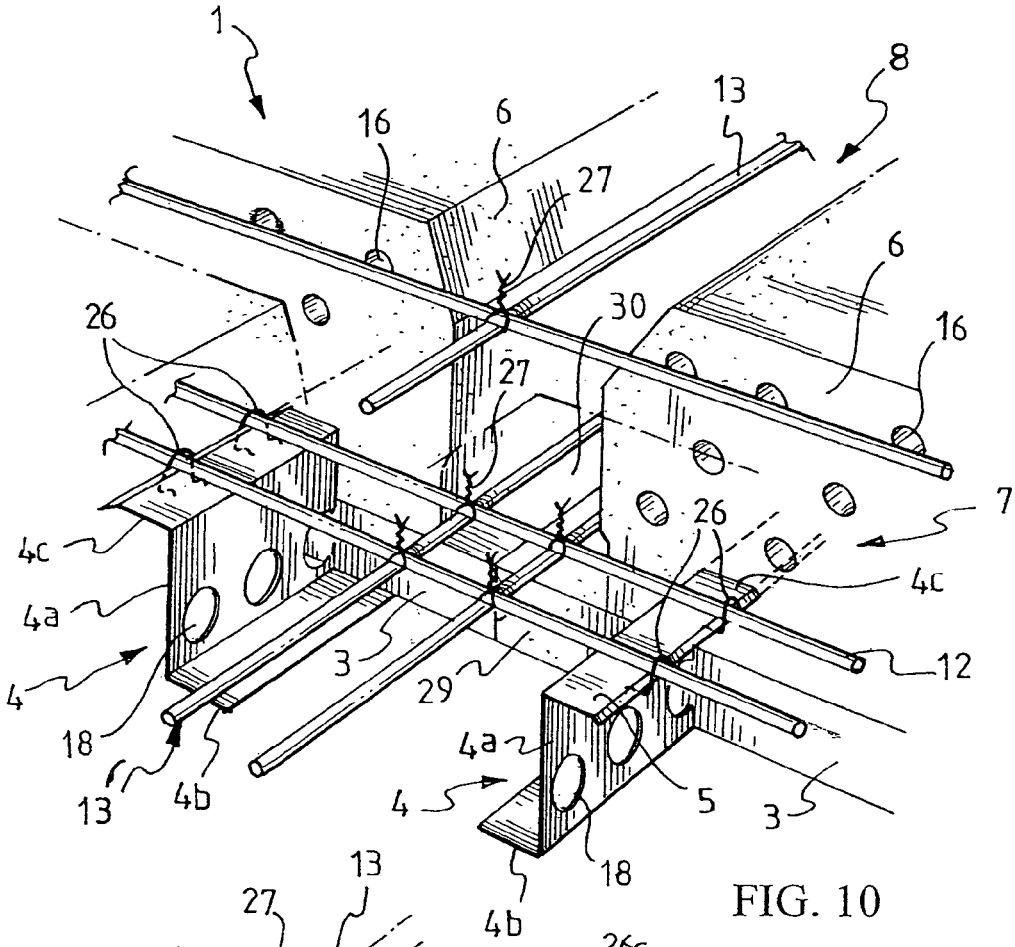
FIG. 10 shows a perspective view, in enlarged scale, of some details of an additional alternative preferred embodiment of the floor structure of the invention.

According to the embodiment of the invention illustrated in FIG. 10, the floor structure 1 comprises a plurality of composite construction elements 2 each provided with substantially Z-shaped reinforcing section bars 4.

Similarly to what has been illustrated with reference to FIGS. 8 and 9, the reinforcing section bars 4 are arranged in a mirror fashion at opposite parts of the longitudinal center plane of the elongated body 3 and substantially achieve the same advantages.

The reinforcing section bars 4 are thus provided with a fin-shaped lower portion 4*b* extending substantially flush with the lower face 3*b* of the elongated body 3 and with an upper portion 4*c*, fin-shaped as well, defining an upper face 5 which protrudes at a predetermined distance from the upper face 3*a* of the elongated body 3.

Also in this case, the transversal elements 12 of the reinforcement metal structure 10 are firmly associated to the upper fin 4*c* by means of the staples 26 which in this case directly engage such a fin via the free ends 26*b*, 26*c* thereof.

Clearly, a man skilled in the art may introduce modifications and variants to the invention described hereinbefore in order to meet specific and contingent application requirements, variants and modifications which anyway fall within the scope of protection as defined in the attached claims.

The invention claimed is:

1. A floor structure comprising:

a plurality of composite construction elements arranged side by side and comprising:

an elongated body made of expanded plastic material provided with an upper face;

at least one reinforcing section bar longitudinally extending in said elongated body and having an upper portion protruding from the upper face of said body;

a substantially reticular reinforcement metal structure of a concrete casting, supported by the upper portion of said at least one reinforcing section bar at a predetermined distance from the upper face of said elongated body made of expanded plastic material;

a plurality of floor elements made of expanded plastic material supported by said composite construction elements and arranged at a predetermined distance from one another so as to define a plurality of transversal channels and a plurality of longitudinal channels adapted to house the concrete casting;

wherein said floor elements are provided at a lower side with at least one longitudinal groove adapted to house the upper portion of said at least one reinforcing section bar.

2. A floor structure according to claim 1, further comprising a plurality of floor elements made of expanded plastic material supported by said composite construction elements and arranged at a predetermined distance from one another so as to define a plurality of transversal channels and a plurality of longitudinal channels adapted to house the concrete casting.

3. A floor structure according to claim 2, wherein said substantially reticular metal structure comprises a plurality of transversal reinforcement elements of the casting housed in said transversal channels.

4. A floor structure according to claim 2, wherein said substantially reticular metal structure comprises a plurality of longitudinal reinforcement elements of the casting housed in said longitudinal channels.

5. A floor structure according to claim 1, wherein said substantially reticular metal structure is firmly associated to said composite construction elements at said at least one reinforcing section bar.

6. A floor structure according to claim 1, wherein the upper portion of said at least one reinforcing section bar is associated to a longitudinal rib projecting in a cantilevered fashion from the upper face of said elongated body made of expanded plastic material.

7. A floor structure according to claim 6, wherein the upper face of said at least one reinforcing section bar is extending at least in part substantially flush with an upper face of said longitudinal rib of the elongated body made of expanded plastic material.

8. A floor structure according to claim 1, wherein the upper portion of said at least one reinforcing section bar is provided with an upper face defining a supporting surface for said substantially reticular metal structure.

9. A floor structure according to claim 8, wherein the upper face of said at least one reinforcing section bar is substantially planar.

10. A floor structure according to claim 1, wherein the upper portion of said at least one reinforcing section bar is substantially hook-shaped.

11. A floor structure according to claim 1, wherein the upper portion of said at least one reinforcing section bar is substantially shaped as a C, substantially as an upturned U or substantially as an L.

12. A floor structure according to claim 1 wherein the upper portion of said at least one reinforcing section bar engages in a substantially snap-wise fashion in said at least one longitudinal groove of said floor elements.

13. A floor structure according to claim 1, wherein said at least one reinforcing section bar is provided with a lower portion extending at least in part substantially parallel to a lower face of the elongated body made of expanded plastic material.

14. A floor structure according to claim 13, wherein the lower portion of said at least one reinforcing section bar is substantially planar.

15. A floor structure according to claim 13, wherein the lower portion of said at least one reinforcing section bar is extending at least in part substantially flush with said lower face of the elongated body made of expanded plastic material.

16. A floor structure according to claim 13, wherein said rigid covering element is associated to the lower portion of said at least one reinforcing section bar.

17. A floor structure according to claim 1, wherein said upper portion and/or said lower portion of said at least one reinforcing section bar is provided with at least one stiffening rib.

18. A floor structure according to claim 1, wherein said at least one reinforcing section bar is provided with a plurality of openings formed in a central portion thereof.

19. A construction element according to claim 1, wherein said at least one reinforcing section bar is coated at least in part with a fire resistant film obtained from a paint selected from the group comprising intumescent paints and antifire paints.

20. A floor structure according to claim 1, further comprising a lath for supporting at least one layer of a suitable covering material, said lath being associated to a lower face of the elongated body made of expanded plastic material of said composite construction elements.

21. A floor structure according to claim 20, wherein said lath is associated to the lower portion of said at least one reinforcing section bar.

22. A floor structure according to claim 20, wherein said covering material is plaster or cement.

23. A floor structure according to claim 22, wherein said covering material incorporates at least one material selected from reinforcing fibers of a suitable material and at least one fire retardant material adapted to impart an improved fire resistance to said covering material.

24. A floor structure according to claim 1, further comprising a rigid covering element associated to a lower face of the elongated body made of expanded plastic material of said composite construction elements.

25. A floor structure according to claim 24, wherein said rigid covering element is a panel of plasterboard, wood, rigid plastic material or other suitable material.

26. A floor structure according to claim 25, wherein said rigid covering element incorporates at least one fire retardant material adapted to impart an improved fire resistance to said rigid covering element.

27. A floor structure according to claim 24, wherein said rigid covering element is coated at least in part with a fire resistant film obtained from a paint selected from the group comprising intumescent paints and antifire paints.

28. A floor structure according to claim 1, wherein said composite construction elements lay at their opposite ends on respective supporting structures of a building.

29. A floor comprising a concrete slab supported by a floor structure according to claim 1.

30. A floor structure comprising:

a plurality of composite construction elements arranged side by side and comprising:

an elongated body made of expanded plastic material provided with an upper face;

at least one reinforcing section bar longitudinally extending in said elongated body and having an upper portion protruding from the upper face of said body;

a substantially reticular reinforcement metal structure of a concrete casting, supported by the upper portion of said at least one reinforcing section bar at a predetermined distance from the upper face of said elongated body made of expanded plastic material;

a plurality of floor elements made of expanded plastic material supported by said composite construction elements and arranged at a predetermined distance from one another so as to define a plurality of transversal channels and a plurality of longitudinal channels adapted to house the concrete casting;

wherein said substantially reticular metal structure comprises a plurality of transversal reinforcement elements of the casting housed in said transversal channels; and wherein said transversal reinforcement elements of the casting are supported by the upper portion of said at least one reinforcing section bar.

31. A floor structure according to claim 30 wherein said longitudinal reinforcement elements of the casting lay on said transversal reinforcement elements of the casting.

32. A floor structure comprising:

a plurality of composite construction elements arranged side by side and comprising:

an elongated body made of expanded plastic material provided with an upper face;

at least one reinforcing section bar longitudinally extending in said elongated body and having an upper portion protruding from the upper face of said body;

a substantially reticular reinforcement metal structure of a concrete casting, supported by the upper portion of said at least one reinforcing section bar at a predetermined distance from the upper face of said elongated body made of expanded plastic material;

wherein said at least one reinforcing section bar is provided with a lower portion extending at least in part substantially parallel to a lower face of the elongated body made of expanded plastic material; and wherein the lower portion of said at least one reinforcing section bar is entirely incorporated in the mass of expanded plastic material and is arranged at a predetermined distance from the lower face of the elongated body made of expanded plastic material.

33. A floor structure comprising:

a plurality of composite construction elements arranged side by side and comprising:

an elongated body made of expanded plastic material provided with an upper face;

at least one reinforcing section bar longitudinally extending in said elongated body and having an upper portion protruding from the upper face of said body;

a substantially reticular reinforcement metal structure of a concrete casting, supported by the upper portion of said at least one reinforcing section bar at a predetermined distance from the upper face of said elongated body made of expanded plastic material;

at least two reinforcing section bars longitudinally extending in the elongated body made of expanded plastic material at opposite parts of the longitudinal center plane of said elongated body along a direction substantially parallel to said center plane.

34. A floor structure according to claim 33, wherein said reinforcing section bars are provided with respective lower portions extending at opposite parts of the longitudinal center plane of said elongated body.

* * * * *